US008302703B2

(12) United States Patent
Rolovic

(10) Patent No.: US 8,302,703 B2
(45) Date of Patent: Nov. 6, 2012

(54) METHOD AND APPARATUS FOR HYDRAULIC STEERING OF DOWNHOLE ROTARY DRILLING SYSTEMS

(75) Inventor: Radovan Rolovic, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/955,609

(22) Filed: Nov. 29, 2010

(65) Prior Publication Data

US 2011/0162890 A1 Jul. 7, 2011

Related U.S. Application Data

(62) Division of application No. 11/945,383, filed on Nov. 27, 2007, now abandoned.

(51) Int. Cl.
*E21B 7/04* (2006.01)
*E21B 17/10* (2006.01)

(52) U.S. Cl. ..... 175/61; 175/76; 175/408

(58) Field of Classification Search ..... 175/61, 175/73, 76, 308, 320, 324, 393, 424, 408
See application file for complete search history.

(56) References Cited

U.S. PATENT DOCUMENTS 2,167,194 A * 7/1939 Anderson ..... 175/73
2,710,170 A * 6/1955 Livingston et al. ..... 175/267
2,873,092 A * 2/1959 Dwyer ..... 175/61
4,241,796 A * 12/1980 Green et al. ..... 175/24
4,416,339 A * 11/1983 Baker et al. ..... 175/61
4,610,321 A * 9/1986 Whaling ..... 175/424
4,787,465 A * 11/1988 Dickinson et al. ..... 175/67
4,790,394 A * 12/1988 Dickinson et al. ..... 175/61
4,836,301 A 6/1989 Van Dongen
4,850,440 A 7/1989 Smet
4,930,586 A 6/1990 Turin et al.
4,991,667 A * 2/1991 Wilkes et al. ..... 175/61
5,099,934 A 3/1992 Barr
5,111,892 A 5/1992 Sinor et al.
5,467,834 A * 11/1995 Hughes et al. ..... 175/61
5,547,031 A * 8/1996 Warren et al. ..... 175/61
5,553,678 A 9/1996 Barr et al.
5,671,816 A * 9/1997 Tibbitts ..... 175/101
6,012,536 A 1/2000 Puttmann et al.
6,116,354 A * 9/2000 Buytaert ..... 175/55
6,142,250 A * 11/2000 Griffin et al. ..... 175/381
6,257,356 B1 * 7/2001 Wassell ..... 175/61
6,341,656 B1 1/2002 Fanuel et al.
6,840,336 B2 * 1/2005 Schaaf et al. ..... 175/27
7,357,182 B2 * 4/2008 Hunt et al. ..... 166/298
7,360,610 B2 * 4/2008 Hall et al. ..... 175/61
7,413,034 B2 * 8/2008 Kirkhope et al. ..... 175/76
7,503,405 B2 * 3/2009 Hall et al. ..... 175/61
7,506,701 B2 * 3/2009 Hall et al. ..... 175/61
7,600,420 B2 * 10/2009 Meek ..... 73/152.54
7,669,669 B2 * 3/2010 Downton et al. ..... 175/45
7,681,665 B2 * 3/2010 Eppink ..... 175/76
7,849,939 B2 * 12/2010 Downton et al. ..... 175/408
2002/0011358 A1 * 1/2002 Wassell ..... 175/73

(Continued)

*Primary Examiner* — Jennifer H Gay
(74) *Attorney, Agent, or Firm* — Chadwick A. Sullivan

(57) ABSTRACT

A technique is used to control the direction of a drill bit or bottom hole assembly via hydraulic steering utilizing a plurality of steering pads. A portion of hydraulic fluid, e.g. drilling fluid, is directed under pressure to a pad interface region proximate each pad. The hydraulic fluid provides additional force against a surrounding wall and/or reduces or eliminates contact between the pads and the surrounding wall.

12 Claims, 4 Drawing Sheets

U.S. PATENT DOCUMENTS

2002/0088648 A1* 7/2002 Krueger et al. ..... 175/99
2002/0179336 A1* 12/2002 Schaaf et al. ..... 175/61
2005/0056463 A1* 3/2005 Aronstam et al. ..... 175/61
2008/0041629 A1* 2/2008 Aronstam et al. ..... 175/61
2008/0053705 A1* 3/2008 Aronstam et al. ..... 175/61
2008/0083567 A1* 4/2008 Downton et al. ..... 175/73
2009/0065262 A1* 3/2009 Downton et al. ..... 175/393
2009/0133931 A1* 5/2009 Rolovic ..... 175/26

* cited by examiner

METHOD AND APPARATUS FOR HYDRAULIC STEERING OF DOWNHOLE ROTARY DRILLING SYSTEMS

CROSS-REFERENCE TO RELATED APPLICATION

The present document is a divisional of U.S. application Ser. No. 11/945,383, filed Nov. 27, 2007, now abandoned.

BACKGROUND OF THE INVENTION

1. Field of the Invention

The present invention relates to a directional rotary drilling method and apparatus; specifically, to a method and apparatus for moving a drill bit along a desired path.

2. Related Art

All methods known to applicant use some manner of mechanical contact with the well bore to achieve the desired steering of the drilling tool, or as in the case of point-the-bit methods, the steering is achieved by offsetting the angle of the drill bit axis relative to the rest of the drill tool. Fluid pressure necessary to cause fluid flow through changing flow geometries (orifices, bends, narrow passages, conduits, etc.) commonly described as pressure loss is typically considered a negative effect of changing flow conditions because it often requires alternative design requirements. That same changing fluid flow conditions is used in the described method and apparatus to create a pressure differential between the two sides of the drilling tool and thereby achieve a desired lateral force on the drilling tool useable for steering the tool in the given direction. There have been attempts to use changing directional fluid flows that are different than this invention and not intended to use the hydraulic pressure difference around the drilling tool for steering the tool in the preferred direction. See U.S. Pat. No. 4,836,301 as an example of these types of fluid directing systems, which uses changing direction of drilling fluid flow inside the drilling tool to generate a hydrodynamic force to tilt the drill bit axis in a given direction using a point-the-bit steering method and system.

SUMMARY OF THE INVENTION

Hydraulic steering of a drill bit comprises utilizing a plurality of steering pads to steer a bottom hole assembly. A portion of hydraulic fluid, e.g. drilling fluid, is directed under pressure to a pad interface region proximate each pad. The hydraulic fluid provides additional force against a surrounding wall and/or reduces or eliminates contact between the pads and the surrounding wall.

DETAILED DESCRIPTION

Figure 1:
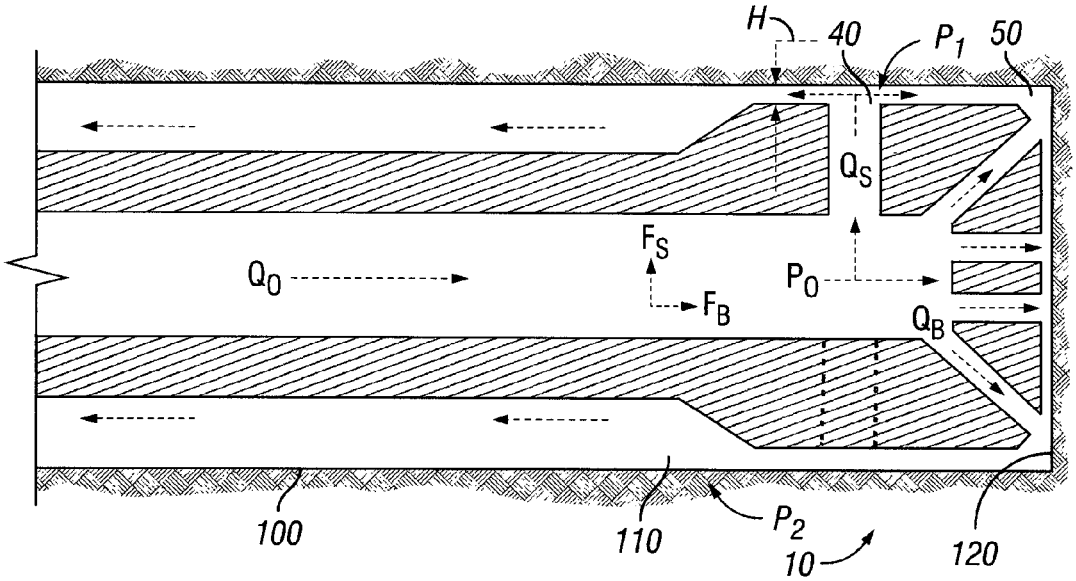
FIG. 1 is a schematic diagram of a lateral orifice arrangement located in a drill bit.

As shown in FIG. 1, a method for hydraulic steering of a down hole drilling tool without the mechanical contact of the tool steering section with the bore hole 100 is presented herein. Substantial lateral hydraulic force on a down hole tool can be achieved by the diversion of a portion of a drilling fluid that is forced to flow out on one side of the tool into the relatively small annular gap h between the lateral edge of the tool 10 and the bore hole 100. As more fully shown in the schematic drawing of FIG. 1, the pressure differential created this way around the tool/bit 50 in the tool-borehole annulus 110 can produce a large lateral force, depending on the geometry of the flow (the gap width h and length, size of the lateral fluid exit hole, etc.), pressure differential between the inside of the tool and the outside of the tool, fluid properties, and other factors. The lateral force on the tool and/or the bit 50 created this way can be sufficient to provide steering of down hole drilling systems. The hydraulic lateral force can be achieved by using a design that is similar to the current bias or steering unit design, but which has a plurality of lateral orifices 40 (one of which is shown via this cross-sectional view and another is represented via dashed lines), instead of the current pad-piston assembly. The lateral orifice 40 exit area needs to be sufficiently close to the borehole wall or face 100 to ensure a sufficiently small gap h between the lateral edge of the tool body 10 where the side orifice 40 is located and the borehole 100 in order to provide enough pressure differential around the tool in the tool-borehole annulus 110. The lateral force can also be achieved with lateral orifices 40 placed in the hole gauge 10 next to the drill bit 50 itself, where a smaller gap h between the tool 50 and the borehole 110 is easier to maintain during drilling (the smaller the gap, the bigger the hydraulic side force).

As the entire drilling BHA is rotated during drilling, including the lateral orifices, one or more lateral orifices are open only when they are approximately opposite to the desired change in drilling direction, while all other lateral orifices are closed until they get approximately opposite to the desired change in drilling direction as the entire BHA rotates around its longitudinal axis. The corresponding opening and closing of the lateral orifices, or opening and closing of the drilling fluid paths to these orifices, can be achieved and controlled by using existing methods for opening and closing fluid paths to the steering pads of a traditional bias or steering unit and controlling the process with a traditional control unit that performs necessary measurements and provides control and steering functions. For example, a counter-rotating valve that rotates at the same rotational speed as the drilling BHA but in the opposite direction can be used to open and close the drilling fluid path to the lateral orifices, thus keeping the fluid flow through the lateral orifices geo-stationary, i.e. in the same relative direction/orientation to the earth, while the rest of the drilling BHA rotates relative to the earth. The drilling fluid flow through the lateral orifices is kept geo-stationary in the lateral direction that is opposite to the desired change in drilling direction.

The desired opening and closing of the lateral orifices or the fluid paths to these orifices also can be achieved by other means, such as a piston or valve mechanism controlled from the control unit that measures the relative BHA position and orientation in real time, or by other means.

The described methods and mechanisms can also be used to direct the drilling BHA to drill straight ahead in a straight line along its longitudinal axis. For example, the rotary valve described above can be used to direct the drilling fluid flow to one or more lateral orifices to achieve the desired lateral hydraulic force and the corresponding drill bit movement in the opposite direction. When the rotary valve is not kept geo-stationary but instead it is rotated fully or partially with the rest of the BHA, or partially counter rotated relative to the BHA, the drilling fluid is effectively directed to the lateral orifices while they are in various orientations to the earth, thus applying the lateral hydraulic force in all directions around the bore hole and thus directing the drilling BHA straight ahead along its longitudinal axis. Another way of directing the BHA to drill straight ahead is to open all the lateral orifices at the same time, or to close all lateral orifices while drilling straight and switch back to the steering mode when the BHA starts to deviate from the straight path.

Figure 4:
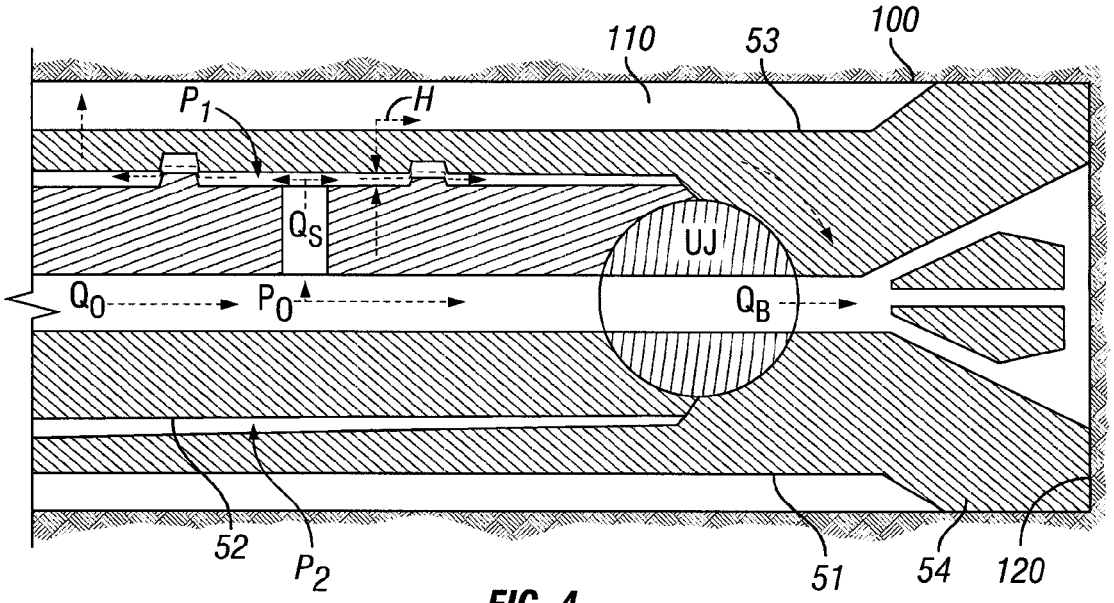
FIG. 4 is a schematic diagram of a point-the-bit rotary steering system using the hydraulic force from the orifice to move fluid against a pivot arm of the bit.

In another embodiment as shown in FIG. 4, the proposed method can be used to achieve steering of a drilling tool 51 by discharging a portion of the drilling fluid into the tool-borehole annulus on one side of the drilling tool between two integral parts of the down hole tool itself, for example, between the tool inner body 52 and an outer sleeve 53 connected together with a universal joint UJ, where the outer sleeve 53 is connected to the bit shaft 54, and where an angular offset of the sleeve 53 and the bit axis relative to the tool inner body axis, which provides the desired steering of the bit, is achieved by a similar hydraulic force. By opening the lateral orifices only when they are opposite to the desired change in the drilling direction as the BHA rotates, and by using one of the methods described above for controlling the opening and closing of the lateral orifices, the outer sleeve 53 and the drill bit axis are kept at an angular offset relative to the rest of the BHA, which steers the tool in the direction of the angular offset that is kept geo-stationary in the desired drilling direction.

Current directional drilling systems use a down hole mud motor with a bend sub or a rotary steerable system (RSS) with a steering section to create a 2-D or a 3-D well bore trajectory. RSS systems have many advantages over mud motor systems and are used for most drilling applications today. The current RSS systems use push-the-bit or point-the-bit approaches to achieve the desired steering of the drilling tool.

Figure 5:
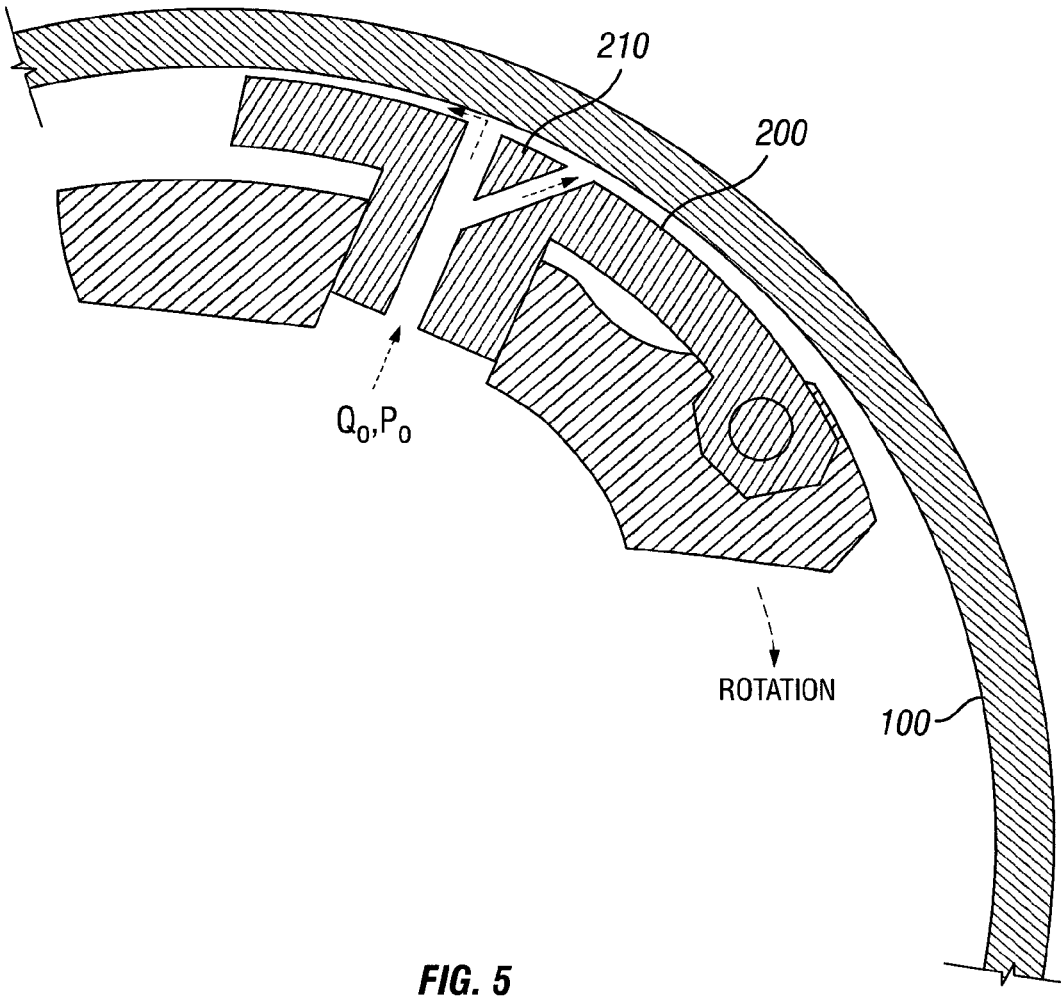
FIG. 5 is a schematic diagram of an orifice arrangement in the body of a directional drilling control pad.

Most of the today's drilling market is covered by systems using the push the bit technology, which uses mechanical pads 200, an example of which is partially shown in FIG. 5, that extend radially from the drilling tool and push against the borehole 100 to achieve a side force on the tool that in turn forces the bit to drill in the same direction of the side force acting on the tool. The principal problem with these pad systems is high wear that results from contacts with the borehole 100, which results in a high manufacturing and repair cost and therefore an overall higher cost of service delivery. The novel approach proposed herein minimizes mechanical contacts with the bore hole for steering purposes.

Figure 6:
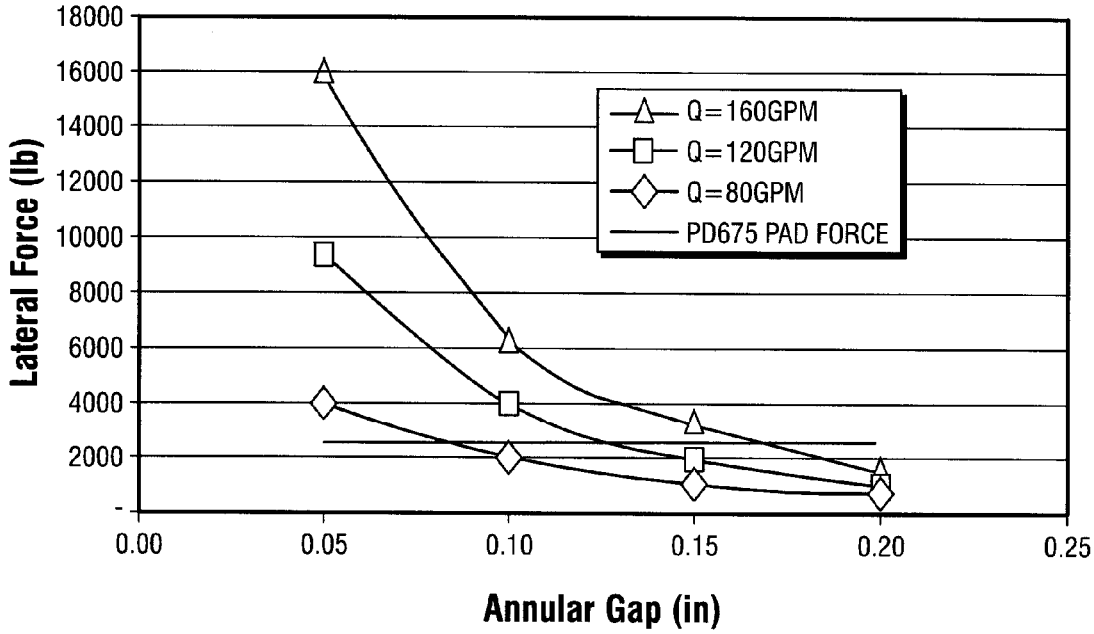
FIG. 6 is a graph describing the expected relation between the annular gap and the lateral hydraulic force at various flow rates.
Figure 7:
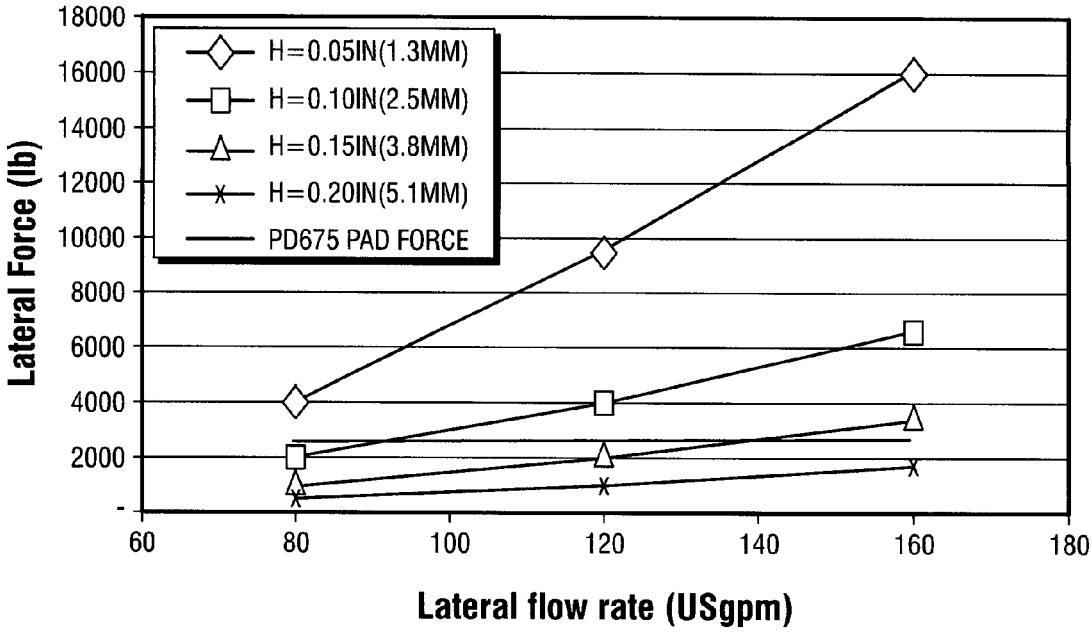
FIG. 7 is a graph describing the expected relation between the lateral flow rate and the lateral hydraulic force at various gap distances.

Pressure drop test data show that a large pressure differential and thus a large lateral force could be achieved with the currently used pressure difference between the inside and the outside of the drilling tool and with a fraction of the current overall flow rate of the drilling fluid. FIGS. 6 and 7 summarize this relationship.

Figure 2:
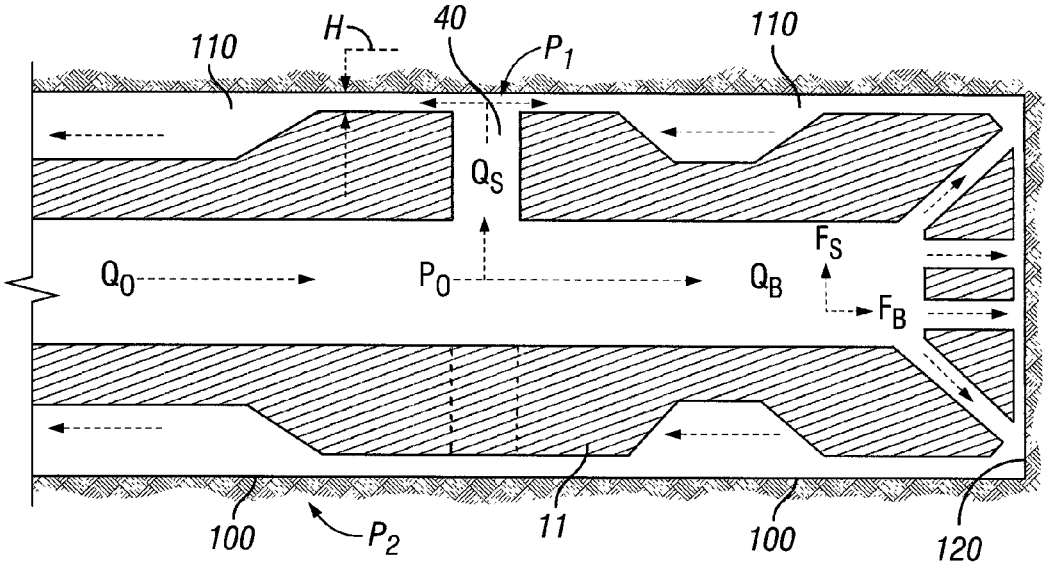
FIG. 2 is a schematic diagram of the lateral orifice arrangement located in a bottom hole assembly.

Steering of the drilling tool or drill bit can be achieved by applying hydraulic forces to one side of the tool, thus achieving the steering of the tool in the opposite direction. The concept of the proposed invention can be explained by using FIG. 2. A portion of drilling fluid (mud) is diverted through a lateral orifice ($Q_s$) and into a narrow gap (h) between the tool steering section 11 and the borehole 100. Only orifices 40 on one side of the tool are opened for the lateral fluid flow ($Q_s$) at a time to provide a pressure differential between that and the opposite side of the tool ($p_1-p_2$), thus creating a lateral hydraulic force on the tool and the bit ($F_s$), which steers the tool and the bit in the opposite direction of the side flow $Q_s$. The pressure differential is achieved principally by the pressure required to push a certain amount of drilling fluid (at fluid flow rate—$Q_s$) through the tight gap between the tool and the borehole (dimension h in FIG. 2). The pressure needed to push the fluid through the narrow tool-borehole gap h is provided by the pressure difference between the inside $p_o$ and the outside of the drilling tool $p_2$.

Figure 3:
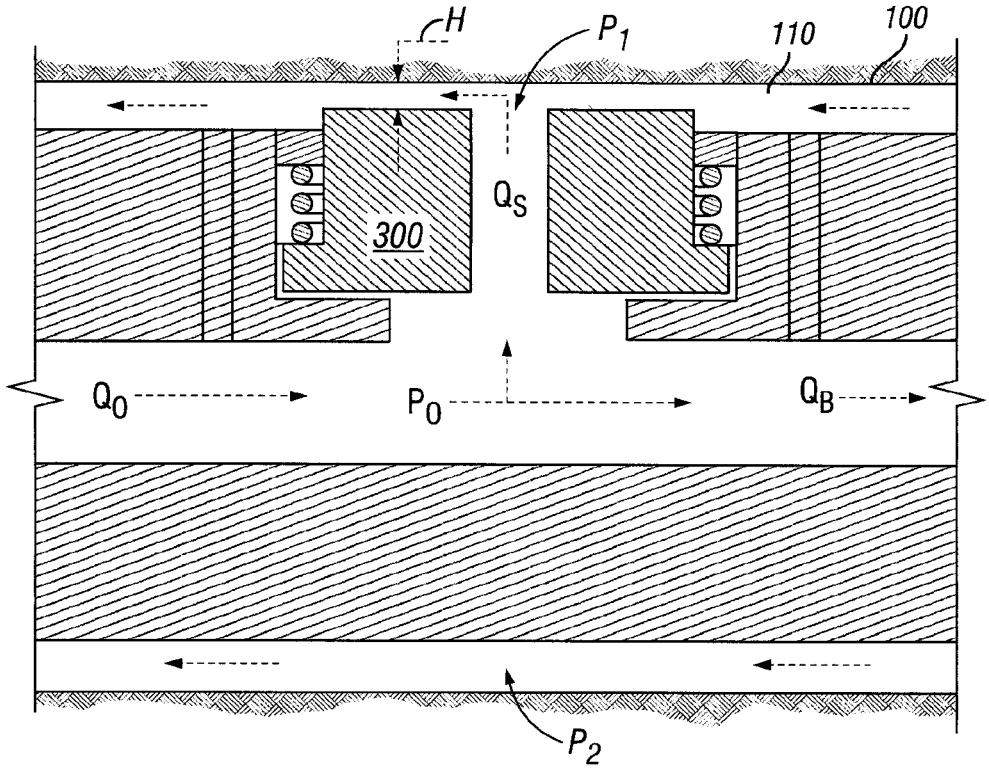
FIG. 3 is a schematic diagram of an adjusting orifice body which moves the distal tip of the orifice closer to a lateral well bore face.

In another embodiment, the lateral discharge of portion of the drilling fluid $Q_s$ can be forced into an even tighter annular gap h between the bit hole gauge section 10 and the bore hole 100 on an adjacent lateral side of the drill bit 50 as shown in FIG. 1. In this manner, a higher lateral hydraulic force $F_s$ for steering the bit can be achieved with less fluid loss. Also, this system may be less complex because it would eliminate the need for an entirely separate steering section/module of the downhole tool. For example, the flow control mechanism, e.g. a rotary valve, can be part of the control unit, and the lateral orifices used for steering can be part of the drill bit assembly. Traditionally, there is a separate steering section/module, e.g. a bias unit, between the drill bit and the control unit. If the annular gap (h) between the tool 50 in FIG. 1 or 11 in FIG. 2 and the borehole 100 is too large or may change significantly during drilling, a modified orifice body, an example of which is shown in FIG. 3, can be used to provide a self-adjusting tight annular gap (h). The fluid pressure on the inner end of the adjustable adapter $p_o$ would push the adapter 300 radially outwards, reducing the annular gap (h) in the process. When the annular gap h is small enough to produce fluid pressure on the outer end of the adapter 300 (in the gap h) which produces an inward force on the adaptor end that is equal to the outward force on the adaptor from the inner fluid pressure, the adaptor reaches an equilibrium state resulting in an annular gap (h) that can be smaller than those described in the previous examples. The size of the adjustable gap (h) mainly depends on the geometry of the adaptor, geometry of the fluid flow, and the pressure difference between the inside and the outside of the drilling tool. Thus, a desired, self-adjusting annular gap h can be achieved and maintained by carefully specifying and controlling these parameters. When the adapter 300 is not used for steering purposes, and to prevent it from protruding radially out of the BHA too much, a spring, or an elastomer or other means can be used to keep the adapter in its inner-most position inside the BHA, example of which is shown in FIG. 3. In another embodiment, the proposed method can be used to achieve steering of a drilling tool by discharging a portion of the drilling fluid on one side of the drilling tool between two integral parts of the down hole tool itself, for example, between the tool inner body 52 and an outer sleeve 53 connected together with a universal joint (UJ), as shown in FIG. 4, where the outer sleeve 53 is connected to the bit shaft 54, and where an angular offset of the sleeve and the bit axis relative to the tool inner body axis, which provides the desired steering of the bit, is achieved by a similar hydraulic force. The particular design concept in FIG. 4 can be optimized to further restrict the exit of the fluid between the sleeve and the tool inner body to increase the pressure ($p_1$) between the two parts, thus increasing the differential pressure ($p_1-p_2$) and increasing the hydraulic lateral force $F_s$ that is used for steering. The proposed method also can be used with the existing drilling tool designs to minimize the abrasion wear and tool shocks and vibrations as shown in FIG. 5. A small amount of drilling fluid can be discharged under pressure through the pad 200 at the pad-bore hole interface 210 to produce a hydraulic force $F_s$ on the pad and reduce or eliminate the mechanical contact between the pad 200 and the bore hole 100. Because the gap between the active pad and the bore hole is very small or basically non-existent while the pad is pushing against the bore hole, only a small amount of drilling fluid would need to be discharged to achieve a relatively large hydraulic lateral force between the pad 200 and the borehole 100 and, therefore, minimize or eliminate the mechanical contact between the pad 200 and the borehole 100.

Estimates of the lateral hydraulic forces associated with the steering method described herein are shown in FIG. 6 and FIG. 7. The pressure in the annular gap h between the tool and the bore hole used to calculate these lateral hydraulic forces was estimated based on measured pressure drop data when water was pumped through a down hole nozzle with an equivalent overall fluid discharge area (total area of all nozzle orifices). The pressure distribution in the annular gap was assumed to correspond to the measured pressure drop through the down hole nozzle for the same total flow area, i.e. the fluid flow in the annular gap h requires the same pressure to achieve the same flow rate as the fluid flow through the nozzle for the same flow area (total nozzle orifice area). Since the flow area in the annular gap h progressively increases with distance from the lateral orifice, the pressure in the gap was estimated at various radial distances from the lateral orifice and the lateral force was calculated as the sum of products of each discrete pressure and the corresponding tool area. Although these pressure-force estimates are based on test data from a different flow system, they provide an approximation of the pressure distribution in the annular gap h and the lateral hydraulic force $F_s$ on the drilling system under consideration.

As can be seen from FIG. 6 and FIG. 7, lateral hydraulic forces higher than the pad forces of a comparable commercial drilling system, shown as Standard Pad system in FIG. 6 and FIG. 7, can be achieved for many practical flow rates and annular gaps, which depend on the hole size drilled, among other factors. For the examples in FIG. 6 and FIG. 7, practical flow rates through the lateral orifices (lateral flow rates) can be on the order of 100 gpm and the practical annular gap h can be on the order of 2 mm, but other lateral flow rates and annular gaps can be practical as well. For example, a tighter annular gap h can be made practical with the method and mechanism shown in FIG. 3, thus increasing the lateral hydraulic force even further, and reducing the required lateral flow rate for effective steering of the drilling BHA. Additionally, to achieve a higher pressure in the annular gap h and, consequently, higher lateral force $F_s$ for hydraulic steering of the drilling tool, the geometry of the annular flow can be changed so that a higher pressure drop is achieved in the annular gap both near and away from the lateral orifice, for the same nominal annular gap h and the same lateral fluid flow rate $Q_s$. For example, the lateral flow can be discharged in the localized annular gap at multiple points in different directions to create a higher pressure drop and a higher pressure in a larger annular gap area, producing a larger lateral force (e.g. multiple lateral flows in the same annular gap would flow against each other, thus possibly creating a higher pressure drop before the fluid exits the annular gap area). Other ways, for example without limitation include changing the flow and tool geometries, fluid properties, and pressure differentials can be substituted for a more optimized hydraulic lateral forces on the drilling tool thereby providing adequate steering with a minimum disruption to the fluid flow through the drill bit.

Numerous embodiments and alternatives thereof have been disclosed. While the above disclosure includes the best mode belief in carrying out the invention as contemplated by the named inventors, not all possible alternatives have been disclosed. For that reason, the scope and limitation of the present invention is not to be restricted to the above disclosure, but is instead to be defined and construed by the appended claims.

What I claim is:

1. A method for hydraulic steering of a drill bit comprising:
- setting an angular direction from a longitudinal axis of a bottom hole assembly providing the drill bit;
- opening one or more lateral orifices at a selected interval to divert drilling fluid from the drill bit to provide motive hydraulic force in an angular direction opposite the angular direction required for forward progress of the drill bit toward the set direction;
- diverting a portion of drilling fluid through a lateral pad of a rotary steerable drill bit system to direct additional force against a lateral bore hole wall; and
- continually discharging the portion of drilling fluid through the lateral pad to minimize contact between the lateral pad and the lateral bore hole wall during hydraulic steering of the drill bit.

2. The method of claim 1 further comprising using a control module/unit to measure and process drilling parameters, direction and orientation of the BHA, and using that information to achieve the desired drilling direction.

3. A directional drilling device, comprising:
- a bottom hole assembly having:
  - a plurality of pads which are actuated in a radial direction against a surrounding wall to steer the bottom hole assembly;
  - a pad-borehole interface at each pad and at which a hydraulic fluid is released continually through the pad-borehole interface to minimize mechanical contact between each pad and the surrounding wall during steering of the bottom hole assembly; and
  - a system to control flow of the hydraulic fluid to each pad of the plurality of pads.

4. The directional drilling device of claim 3, wherein the hydraulic fluid is released through the pads.

5. The directional drilling device of claim 3, wherein the hydraulic fluid is released through lateral orifices in the pads.

6. The directional drilling device of claim 5, wherein the lateral orifices are located in a separate BHA section between the drill bit and the control unit.

7. A method for hydraulic steering of a drill bit comprising:
- setting an angular direction from a longitudinal axis of a bottom hole assembly which includes the drill bit;
- controlling pads with a drilling fluid to force the pads in a direction opposite the angular direction required for forward progress of the drill bit in the angular direction; and
- discharging a portion of the drilling fluid at an interface between each pad and a surrounding wall to create additional force against the surrounding wall while substantially eliminating contact between each pad and the surrounding wall during hydraulic steering of the drill bit.

8. The method of claim 7, wherein discharging comprises discharging a sufficient amount of the drilling fluid at the interface to reduce mechanical contact between each pad and the surrounding wall.

9. The method of claim 7, wherein discharging comprises discharging a sufficient amount of the drilling fluid at the interface to reduce mechanical contact between each pad and the surrounding wall in the form of a wellbore wall.

10. The method of claim 7, wherein discharging comprises discharging a sufficient amount of the drilling fluid at the interface to eliminate mechanical contact between each pad and the surrounding wall.

11. The method of claim 7, wherein discharging comprises discharging the drilling fluid through openings formed through the plurality of pads.

12. The method of claim 7, further comprising determining a direction for forward progress of the drill bit and directing the flow of drilling fluid to act against a universal joint sleeve connected to the drill bit to orient the drill bit in the angular direction.

* * * * *